US005630287A

United States Patent [19]

Shimosaka et al.

[11] Patent Number: 5,630,287

[45] Date of Patent: May 20, 1997

[54] ELECTRIC STEAM IRON

[75] Inventors: Kiichi Shimosaka, Moriguchi; Masao Shimizu, Nishinomiya; Atsushi Matsuo, Takarazuka; Naruaki Akai, Kawanishi; Shinichiro Kobayashi, Osaka; Hiroshi Fujimoto, Takatsuki, all of Japan

[73] Assignee: Matsushita Electric Co., Ltd., Osaka, Japan

[21] Appl. No.: 565,054

[22] Filed: Nov. 30, 1995

[30] Foreign Application Priority Data

Nov. 30, 1994 [JP] Japan ..... 6-296582

[51] Int. Cl.[6] ..... D06F 75/18

[52] U.S. Cl. ..... 38/77.3; 38/77.83

[58] Field of Search ..... 38/77.8, 77.83, 38/77.3, 77.7

[56] References Cited

U.S. PATENT DOCUMENTS 4,656,763 4/1987 Kawasaki et al. ..... 38/77.83
5,074,066 12/1991 Sakano et al. ..... 38/77.8

FOREIGN PATENT DOCUMENTS 60-129095 7/1985 Japan .
61-263493 11/1986 Japan .
2136190 5/1990 Japan ..... 38/77.83
3-295597 12/1991 Japan .

*Primary Examiner*—Ismael Izaguirre
*Attorney, Agent, or Firm*—Ratner & Prestia

[57] ABSTRACT

An electric steam iron having a standard steam spray mode for spraying a standard quantity of steam and an enhanced steam spray mode for spraying an increased quantity of steam as compared with that afforded during the standard steam spray mode. This electric steam iron includes a soleplate having a heater mounted thereon for heating the soleplate and a vaporizing chamber defined therein, a handle disposed above the soleplate, a water tank unit for supplying water to the vaporizing chamber, and a nozzle disposed at a bottom of the water tank unit. The electric steam iron also includes a valving mechanism for selectively opening and closing the nozzle for controlling supply of water to the vaporizing chamber, and a pumping mechanism for supplying an increased quantity of water within the water tank unit towards the vaporizing chamber to accomplish the enhanced steam spray mode. A cover plate is secured to a bottom wall member of the water tank unit so as to define a water passage beneath the water tank unit and covering the pumping mechanism and an exit side of the nozzle. This cover plate has an opening defined therein in communication with the vaporizing chamber.

14 Claims, 7 Drawing Sheets

ELECTRIC STEAM IRON

BACKGROUND OF THE INVENTION

1. Field of the Invention

The present invention relates to an electric steam iron capable of producing steam from water to smooth down the creases in cloth or the like.

2. Description of the Prior Art

Various types of electric steam irons are currently available in the market. For example, the Japanese Laid-open Pat. Publications No. 60-129095 published in 1985, No. 61-263493 published in 1986, and No. 3-295597 published in 1995, discloses such electric steam irons as reproduced in FIGS. 8 to 10 of the accompanying drawings, respectively.

Referring first to FIG. 8, the prior art steam iron disclosed in the Japanese Laid-open Pat. Publication No. 60-129095 has a vaporizing chamber 3 defined in an iron base plate or soleplate 2 adapted to be heated by a heater 1. Water within a removable tank 4 is supplied dropwise into the vaporizing chamber 3 through a nozzle 5 so that, when the soleplate 2 is heated, drops of water so supplied can be vaporized to produce steam. The nozzle 5 is selectively opened and closed by a valving mechanism 7 adapted to be manipulated by a spray button 6. The prior art steam iron also has a pump unit 8 built therein for supplying an additional amount of water dropwise into the vaporizing chamber 3 to temporarily increase the amount of steam being sprayed to thereby enhance removal of the stubborn creases from the clothing.

The prior art steam iron shown in FIG. 8 has some disadvantages. Namely, since the nozzle 5 and a discharge port of the pump unit 8 both provided in the tank 4 are separate from each other and are fluid-coupled with the vaporizing chamber 3, not only are complicated seals required one for each of the nozzle 5 and the discharge port of the pump unit 8, but it is difficult to avoid a water leakage which would occur from a connection between the vaporizing chamber 3 and each of the nozzle 5 and the discharge port of the pump unit 8.

Also, if the user of the steam iron inadvertently depresses the spray button 6 to open the nozzle after the heater 1 has been electrically energized, but before the vaporizing chamber 3 attains a vaporizing temperature required for the water therein to be vaporized, the water supplied dropwise into the vaporizing chamber 3 egresses as a heated water without being vaporized and, once this occurs, the clothing being ironed may be stained.

Moreover, where the valving mechanism 7 is repeatedly driven up and down at a time during an ironing job, the vaporizing chamber 3 is rapidly cooled down to a temperature lower than the vaporizing temperature at which the water can be vaporized. Even in this case, the water supplied dropwise into the vaporizing chamber 3 egresses as a heated water without being vaporized and, once this occurs, the clothing being ironed may be stained. Furthermore, if the user having completed the ironing job fails to set the spray button 6 in position (i.e., in a depressed position) to close the nozzle 5 while the water remains within the tank 4, the water remaining within the tank 4 will leak into the vaporizing chamber 3, causing the wall defining the vaporizing chamber to be corroded.

The prior art steam iron of a type shown in FIG. 9, i.e., that disclosed in the Japanese Laid-open Patent Publications No. 61-263493, appears to effectively eliminate the foregoing problems inherent in the steam iron shown in FIG. 8. This prior art steam iron shown in FIG. 9 makes use of a thermo-responsive valve assembly 10 including a valve rod and a bimetal element 11 mounted on the soleplate at a location immediately beneath the valve rod and operatively associated with the bimetal element. This thermo-responsive valve assembly 10 is disposed on a guide passage 9 communicating between the tank 4 and the vaporizing chamber 3, so that when the water within the vaporizing chamber 3 is heated to the vaporizing temperature, the bimetal element 11 can be convexed in response to the temperature of the soleplate 2 to lift a valve rod of the thermo-responsive valve 10 to thereby open the guide passage 9. A pump unit 12 employed for a purpose similar to the pump unit 8 employed in the steam iron shown in FIG. 8 is also disposed on the guide passage 9 and includes a normally upwardly biased pumping member 13 which, when driven repeatedly up and down, pumps water from the tank 4 through the guide passage 9 into a cylinder 14 and then discharges into a portion of the guide passage 9 adjacent the vaporizing chamber 3 to thereby supply an increased amount of water into the vaporizing chamber 3 so that the steam being sprayed can be temporarily increased to enhance removal of the stubborn creases from the clothing.

When the pumping member 13 is locked in a depressed position having moved against a biasing force necessary to keep the pumping member 13 at a normally upwardly biased position, the guide passage 9 can be closed to interrupt the supply of water from the tank 4 towards the vaporizing chamber 3. On the other hand, at the normally upwardly biased position of the pumping member 13, the latter is clear from the guide passage 3, allowing the supply of water from the tank 4 towards the vaporizing chamber 3 to effect a standard steam spraying.

According to the prior art steam iron shown in FIG. 9, a water discharge port of the tank 4, a discharge port of the pump 12 and the valve rod of the thermo-responsive valve 10 are required to be disposed at respective positions spaced horizontally from each other, but substantially in level with each other, and this structural requirement increases the distance from an intake port of the guide passage 9 to an outlet port thereof along an upper region of the soleplate 2. The greater the length of the guide passage 9, the lower the response is in which a relatively large time lag occurs in initiating or stopping the spray of steam in response to selective opening or closure of the guide passage 9.

In addition, considering that when the iron is used for actual ironing without the steam spraying function utilized the guide passage 9 is overheated by the heat evolved in the soleplate 2, supply of water into the guide passage 9 in an attempt to spray the steam while the guide passage 9 is overheated results in boiling of water within the guide passage 9 accompanied by cavitation to suffocate the guide passage 9. Once this occurs, a smooth flow of water through the guide passage 9 is hampered to such an extent as to result in the incapability of the steam iron to accomplish a stabilized spraying of steam.

The prior art steam iron shown in FIG. 9 is advantageous in that since the single pumping member 13 has, in addition to the standard steam spraying function of selectively initiating and interrupting a standard steam spraying, an enhanced steam spraying function in which the quantity of steam being sprayed is temporarily increased, the steam iron as a whole can be designed compact in structure. However, this convenient feature often poses a problem in that if when the pump 12 is desired to be operated the pumping member 13 is inadvertently depressed a distance greater than required, spraying of the steam is abruptly halted. If, however, a regulator means is employed for avoiding an excessive depression of the pumping member beyond the required distance, a different problem would occur in that a relatively strong force may be required to depress the pumping member to overcome the force developed by the regulating means, thereby rendering the pumping member to be difficult to handle.

When the steam iron of the structure shown in either FIG. 8 or FIG. 9 is used for actual ironing, the front tip of the soleplate 2 is often utilized to tactically remove creases from, for example, a narrow and/or confined area of the clothing. In any one of the prior art steam irons shown respectively in FIGS. 8 and 9, it is often experienced that the field of view of the user looking down at the creases in the narrow and/or confined clothing area from above during an actual ironing job with the steam iron being moved to and fro is obstructed by the stem of a body of the steam iron adjacent the front tip of the soleplate. This is because the stem of the prior art steam iron is steeply angled relative to the soleplate or the surface to be ironed, as clearly shown in either FIG. 8 or FIG. 9, with the front tip of the soleplate barely protruding outwardly from a lower region of the stem of the steam iron. To avoid this problem associated with the viewability, the Japanese Laid-open Pat. Publications No. 3-295597 discloses the steam iron of a structure shown in FIG. 10.

Referring to FIG. 10, the prior art steam iron shown therein includes a removable water tank 15 of a generally U-shaped configuration as viewed from top. This removable tank 15 has a stem edge where the opposite side wall of the tank body converge and where a water fill port 16 is defined is substantially streamlined rearwardly to reduce the angle $\alpha$ of inclination of the stem edge relative to the soleplate 2 to thereby permit the user to look down conveniently at the creases in the narrow and/or confined clothing area during the ironing without being substantially obstructed by the stem of the water tank 15.

Since the water fill port 16 is defined in a region of the rearwardly streamlined stem edge, even the prior art steam iron shown in FIG. 10 however has a problem particularly when the tank 15 is removed from the body of the steam iron for refilling water into the tank 15 through the water fill port 16 and is then held with the water fill port 16 laid substantially horizontally, i.e., substantially transverse to the direction of flow of water from a spout. This is because, when water is to be refilled with the water fill port 16 held substantially horizontally, the tank 15 as a whole must be tilted against an ergonomic aspect of tank holding. On the other hand, if the tank 15 removed from the body of the steam iron is held upright with its bottom lying substantially horizontally, the water fill port 16 then tilts relative to the direction of flow of water from the spout or faucet, making it difficult to refill the tank 15.

In addition, when the tank 15 is to be removed from the body of the steam iron then heated to an elevated temperature such as occasionally exercised, for example, when water is to be refilled into the empty tank 15 or when water remaining within the tank 15 is to be removed after the ironing job, or when the refilled tank 15 is to be mounted on the body of the heated steam iron, a covering skirt 17 overhanging the sole plate 2 and heated to an elevated temperature is prone to be touched by the user's hand and, therefore, there is a relatively high possibility that the user may burn his or her hand on a portion of the hot covering skirt 17 adjacent the front tip of the soleplate 2.

SUMMARY OF THE INVENTION

The present invention is therefore devised to substantially eliminate the above discussed problems inherent in the prior art steam irons and has for its primary object to provide an improved steam iron of an easy-to-use type wherein not only is a water-tight connection secured be the tank and the vaporizing chamber, but smooth supply of water from the tank to the vaporizing chamber can be achieved to provide a favorable standard steam spraying mode and also to provide an enhanced steam spraying mode.

Another important object of the present invention is to provide an improved steam iron of the type referred to above, wherein spraying of the steam is assuredly interrupted to enhance an ironing effect acted on the clothing.

A further important object of the present invention is to provide an improved steam iron of the type referred to above, wherein improvement has been made not only in initiating and interrupting the steam spraying, but also in operability under the enhanced steam spraying mode.

A still further important object of the present invention is to provide an improved steam iron of the type referred to above, having an improved viewability with which the user can look down at creases being then smoothed by the front tip of the soleplate and also having a capability of the tank being easily refilled.

A different, but important object of the present invention is to provide an improved steam iron of the type referred to above, wherein a security of the removable tank is ensured.

In order to accomplish the foregoing objects of the present invention, an electric steam iron according to one aspect of the present invention has a standard steam spray mode, in which a quantity of steam is sprayed, and an enhanced steam spray mode in which an increased quantity of steam is sprayed as compared with that afforded during the standard steam spray mode. This electric steam iron comprises a soleplate having a heater mounted thereon for heating the soleplate and having a vaporizing chamber defined therein; a handle disposed above the soleplate; a water tank for supplying water to the vaporizing chamber; a nozzle disposed at a bottom of the water tank; a valving mechanism for selectively opening and closing the nozzle for controlling supply of water to the vaporizing chamber; a pumping mechanism for supplying an increased quantity of water within the water tank towards the vaporizing chamber to accomplish the enhanced steam spray mode; and a cover plate defining a water passage beneath the water tank and covering the pumping mechanism and an exit side of the nozzle. The cover plate has an opening defined therein in communication with the vaporizing chamber.

This is particularly advantageous in that water dropping from the nozzle and water discharged by the pumping mechanism can be supplied towards the vaporizing chamber through the single opening in the cover plate and, therefore, a reliably fluid-tight seal can be obtained between the vaporizing chamber and the water tank so that during the standard steam spraying mode and the enhanced steam spraying mode a stabilized standard spraying of steam and an enhanced spraying of steam can be accomplished in a stabilized fashion, respectively.

The electric steam iron according to another aspect of the present invention similarly has a standard steam spray mode, in which a quantity of steam is sprayed, and an enhanced steam spray mode in which an increased quantity of steam is sprayed as compared with that afforded during the standard steam spray mode. This electric steam iron comprises a soleplate having a heater mounted thereon for heating the soleplate and also having a vaporizing chamber defined therein; a handle disposed above the soleplate; a water tank for supplying water to the vaporizing chamber; a nozzle disposed at a bottom of the water tank; a valving mechanism for selectively opening and closing the nozzle for controlling supply of water to the vaporizing chamber; a pumping mechanism for supplying an increased quantity of water within the water tank towards the vaporizing chamber to accomplish the enhanced steam spray mode; a water guide conduit having an outflow port and operable to guide water within the water tank to flow into the vaporizing chamber; and a thermo-responsive valve assembly operable to open the water guide conduit to establish a fluid circuit when the vaporizing chamber is heated to a vaporizing temperature at which water is vaporized to provide steam.

In this structure, the thermo-responsive valve assembly is disposed at a location between the outflow port of the water guide conduit and a portion of the water guide conduit where water from the pumping mechanism and the nozzle joins the water guide conduit so that even though the water guide conduit is closed by the thermo-responsive valve assembly, the pumping mechanism can be operated and, at the same time, water discharged into the water guide conduit can be returned into the water tank through the nozzle perforation in the nozzle without being supplied towards the vaporizing chamber, thereby accomplishing a cleaning of the nozzle with the water pressurized by the pumping mechanism.

In either case, the opening in the cover plate preferably has a diameter greater than that of a nozzle aperture in the nozzle and is positioned immediately beneath the nozzle so that water supplied dropwise through the nozzle can be supplied to the vaporizing chamber without staying within the water passage, thereby increasing a vaporizing response when the steam is desired to be used.

Preferably, the electric steam iron is further provided with a water guide conduit defined at a downstream side of the opening in the cover plate with respect to a direction of flow of water towards the vaporizing chamber, and a thermo-responsive valve assembly disposed beneath the opening in the cover plate. This thermo-responsive valve assembly is operable to open said water guide conduit to establish a fluid circuit when the vaporizing chamber is heated to a vaporizing temperature at which water is vaporized to provide steam. This is particularly advantageous in that the length of the water guide conduit leading to the vaporizing chamber can be shortened and, at the same time, a possibility of water within the water guide conduit being overheated which would otherwise result in cavitation and, also, a possible accidental leak of the hot water can be eliminated assuredly.

Also, the pumping mechanism may have a discharge port communicated with the water passage, in which case a check valve normally closing the discharge port of the pumping mechanism is provided. This check valve is preferably in the form of a flexible tubular member made of a flexible material and may be supported sandwiched between a bottom wall member of the water tank and the cover plate. This is particularly advantageous in that there is no possibility that the check valve may open the discharge port under the influence of vibrations or impacts imposed on the steam iron during an ironing and, also, any possible leakage of water within the pumping mechanism leaking into the vaporizing chamber through the water passage during the use of the steam iron with the nozzle closed is also eliminated. Also, where the check valve is supported sandwiched between the bottom wall member of the water tank and the cover plate, it is possible to allow water within the pumping mechanism to be gushed into the water passage by urging the check valve to displace downwardly, thereby flushing foreign matter within the water passage.

The electric steam iron according to a further aspect of the present invention similarly has a standard steam spray mode, in which a quantity of steam is sprayed, and an enhanced steam spray mode in which an increased quantity of steam is sprayed as compared with that afforded during the standard steam spray mode. This electric steam iron comprises a soleplate having a heater mounted thereon for heating the soleplate and also having a vaporizing chamber defined therein; a handle disposed above the soleplate; a water tank for supplying water to the vaporizing chamber; a nozzle disposed at a bottom of the water tank; a valving mechanism for selectively opening and closing the nozzle for controlling supply of water to the vaporizing chamber; a pumping mechanism for supplying an increased quantity of water within the water tank towards the vaporizing chamber to accomplish the enhanced steam spray mode; a first operating member having a first operating surface accessible to a user's finger for operating the valving mechanism; and a second operating member having a second operating surface accessible to a user's finger for operating the pumping mechanism. The first and second operating members are juxtaposed with each other in a direction substantially perpendicular to a direction in which the handle extends, and the first operating member has a larger surface area than the second operating surface.

This arrangement makes it possible for the first and second operating members to be positioned spaced an equal distance from a grip region of the handle and, therefore, the user attempting to push the first and second operating members alternately need not move his finger a substantial distance to reach either one of the first and second operating surfaces, and is also effective to lessen a load which would be imposed on the user's finger when the pumping mechanism is operated by moving the second operating member up and down repeatedly.

The electric steam iron according to a still further aspect of the present invention comprises a soleplate having a heater mounted thereon for heating the soleplate and also having a vaporizing chamber defined therein; a covering mounted on the soleplate so as to cover an upper region of the soleplate; a handle disposed mounted on an upper portion of the covering; a removable water tank for supplying water to the vaporizing chamber; and a water fill unit fitted to a front upper portion of the water tank and having a water fill port defined in a front surface of the water fill unit. The water tank has a upper wall member defining an upper surface of the water tank. The upper wall member has a tip formed with a bulged portion protruding forwardly from a lower end of the water fill unit while leaving a setback region at a location between the bulged portion and the water fill unit. In this case, preferably the bulged portion covers upper and side surfaces of a front portion of the covering and is positioned at a level lower than a bottom wall member of the water tank that defines a bottom of the water tank.

According to this aspect of the present invention, the angle of inclination of the water fill unit can be chosen to be greater than the angle of inclination of the covering and, therefore, refilling of water into the water tank can advantageously be performed efficiently without the viewability of the user being hampered. In particular, since the bulged portion is kept at a low temperature by the effect of water within the tank, the bulged portion protects the covering to minimize the surface area of the covering which would be exposed to the outside. Therefore, an accidental touch of the covering during removal or mounting of the water tank relative to the body of the steam iron can be avoided advantageously.

BRIEF DESCRIPTION OF THE DRAWINGS

This and other objects and features of the present invention will become clear from the following description taken in conjunction with preferred embodiments thereof with reference to the accompanying drawings, in which like parts are designated by like reference numerals and in which.

DETAILED DESCRIPTION OF THE EMBODIMENTS

Figure 1:
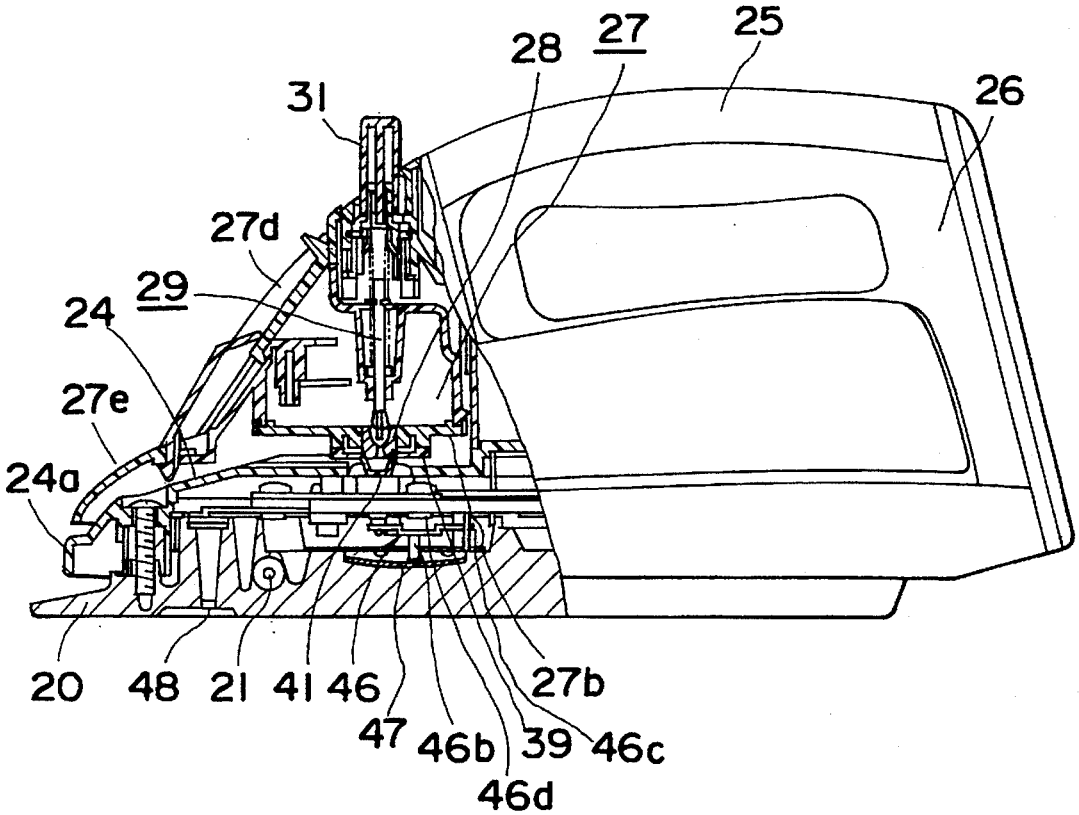
FIG. 1 is a side view, with a front portion cut away, of a steam iron according to a first preferred embodiment of the present invention.
Figure 4:
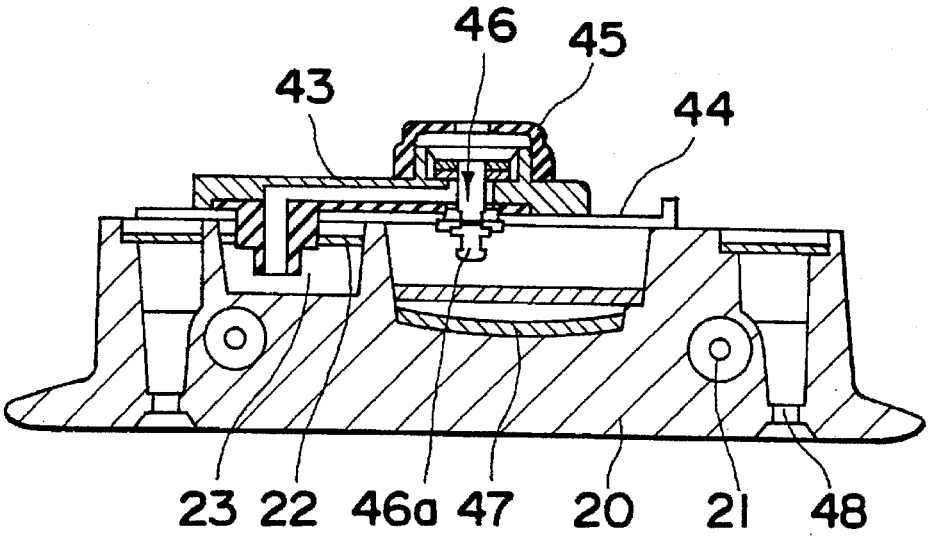
FIG. 4 is a cross-sectional view, on an enlarged scale, taken along the line 4—4 in FIG. 3.
Figure 5:
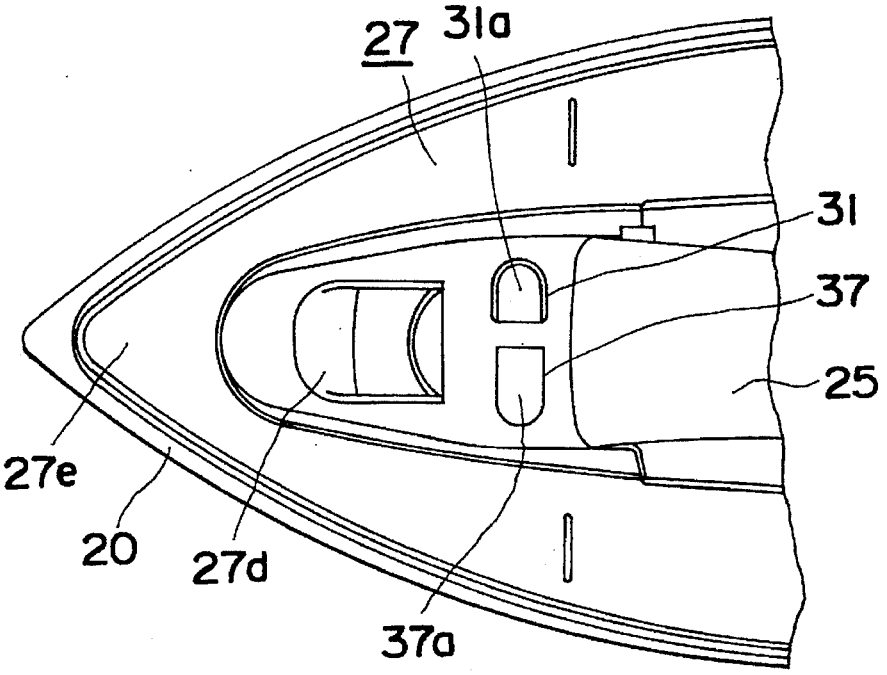
FIG. 5 is a fragmentary top plan view of the steam iron of FIG. 1.

Referring first to FIGS. 1 to 6, a steam iron according to a first preferred embodiment of the present invention comprises a soleplate 20 adapted to be heated by a heater 21, a part of which is utilized to define a vaporizing chamber 23 in cooperation with a vaporizing chamber defining lid 22 as best shown in FIG. 4, and a covering 24 made of heat-resistant synthetic resin and mounted atop the soleplate 20. As best shown in FIG. 1, the covering 24 is of a shape substantially similar to a diagrammatic top plan representation of a ship and has a handle 26 extending upright from a rear or stern portion of the covering 24 and in a direction away from the soleplate 2 and then bent to protrude forward to define a grip region 25 accessible to the hand of a user of the steam iron. This generally ship-shaped covering 24 has a peripheral skirt 24*a* generally protruding downwardly from a peripheral edge of the covering 24.

Reference numeral 27 represents a removable water tank for accommodating therein a quantity of water to be supplied into the vaporizing chamber 23. This water tank 27 is of a generally U-shaped configuration as viewed from top and is of a one-piece structure including generally elongated side tanks and a front tank communicating the side tanks with each other to provide a generally U-shaped tank chamber. This water tank unit 27 also includes a water fill unit 27*c* of a generally triangular shape integral therewith and protruding upwardly from the front tank of the tank unit 27 to a level substantially flush with top of the grip region 25 of the handle 26.

The water tank unit 27 is removably mounted above the covering 24. Although not shown, the handle 26 has a releasable lock button normally held in position to retain the tank unit 27 as mounted, but movable to a release position to allow the tank unit 27 to be removed from the front portion of the covering 24. This tank unit 27 includes an upper wall 27*a* of a generally inverted U-shaped configuration defining the top of the tank unit 27, a bottom wall 27*b* defining the bottom of the tank unit 27 with the water fill unit 27*c* occupying a top front portion of the upper wall 27*a*. A water fill port 27*d* is formed in the water fill unit 27*c* at a location corresponding to the front tank of the water tank unit 27.

Figure 6:
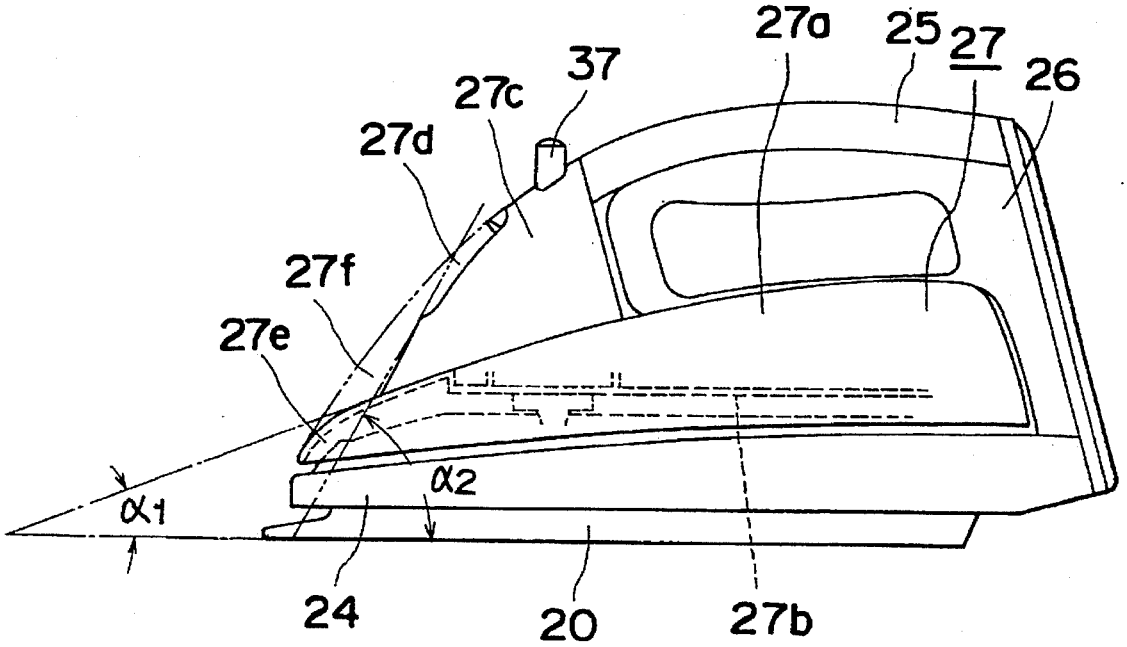
FIG. 6 is a side view of the steam iron of FIG. 1.

As best shown in FIG. 6, a front portion of the tank upper wall 27*a* immediately above the front tip of the soleplate 20 is formed with a bulged portion 27*e* protruding frontwardly from a lower portion of the water fill unit 27*c*, thereby leaving a setback region 27f between the bulged portion 27*e* and the water fill unit 27*c*. This setback region 27*f* is substantially represented by a difference between an angle $\alpha 1$ of inclination of the bulged portion 27*e* relative to the bottom surface of the soleplate 20 and an angle $\alpha 2$ of inclination of the water fill unit 27*c* which is greater than the inclination angle $\alpha 1$. This bulged portion 27*e* is of a design covering a front top and front side portions of the covering 24 with opposite side wall portions of the covering 24 inclined downwardly so as to gradually decrease in their surface area towards the stem of the steam iron, thereby allowing the bulged portion 27*e* to occupy a position lower in level than the tank bottom wall 27*b* as clearly shown in FIG. 1.

The tank bottom wall 27*b* is formed with a nozzle member 28 having a minute metering perforation 28*a* defined therein for supplying water within the tank unit 27 dropwise into the vaporizing chamber 23. The nozzle member 28 may be defined by the use of a separate perforated nozzle member having a minute metering perforation 28*a* defined therein and made of metal, ceramics or synthetic resin. Where this separate perforated nozzle member having the minute metering perforation 28*a* defined therein is employed, the perforated nozzle member may be fitted in a watertight fashion in a socket in the tank bottom wall 27*b* by the use of an ultrasonic welding technique, or by the use of an insert-molding technique or by screwing it into the socket in the tank bottom wall 27*b* with a packing intervening between the separate nozzle member and the peripheral wall of the socket in the tank bottom wall 27*b*. Alternatively, a minute metering perforation 28*a* may be formed directly in the tank bottom wall 27*b*.

Aligned with the nozzle member 28 is a valving member 29 having a lower end engageable in the minute metering perforation 28*a* and an upper end protruding upwardly from the tank unit 27 and capped with a standard spray button 31 having an operating surface 31*a* defined atop the standard spray button 31 and accessible to a user's finger. This valving member 29 is supported for movement up and down in a direction longitudinally thereof, but is normally biased upwardly by a spring element 30. The minute metering perforation 28*a* in the nozzle member 28 can be selectively opened and closed by moving the valving member 29 up and down, respectively. More specifically, by pushing the standard spray button 31 downwardly to move the valving member 29 down, water from the tank unit 27 can flow into the vaporizing chamber 23.

Figure 2:
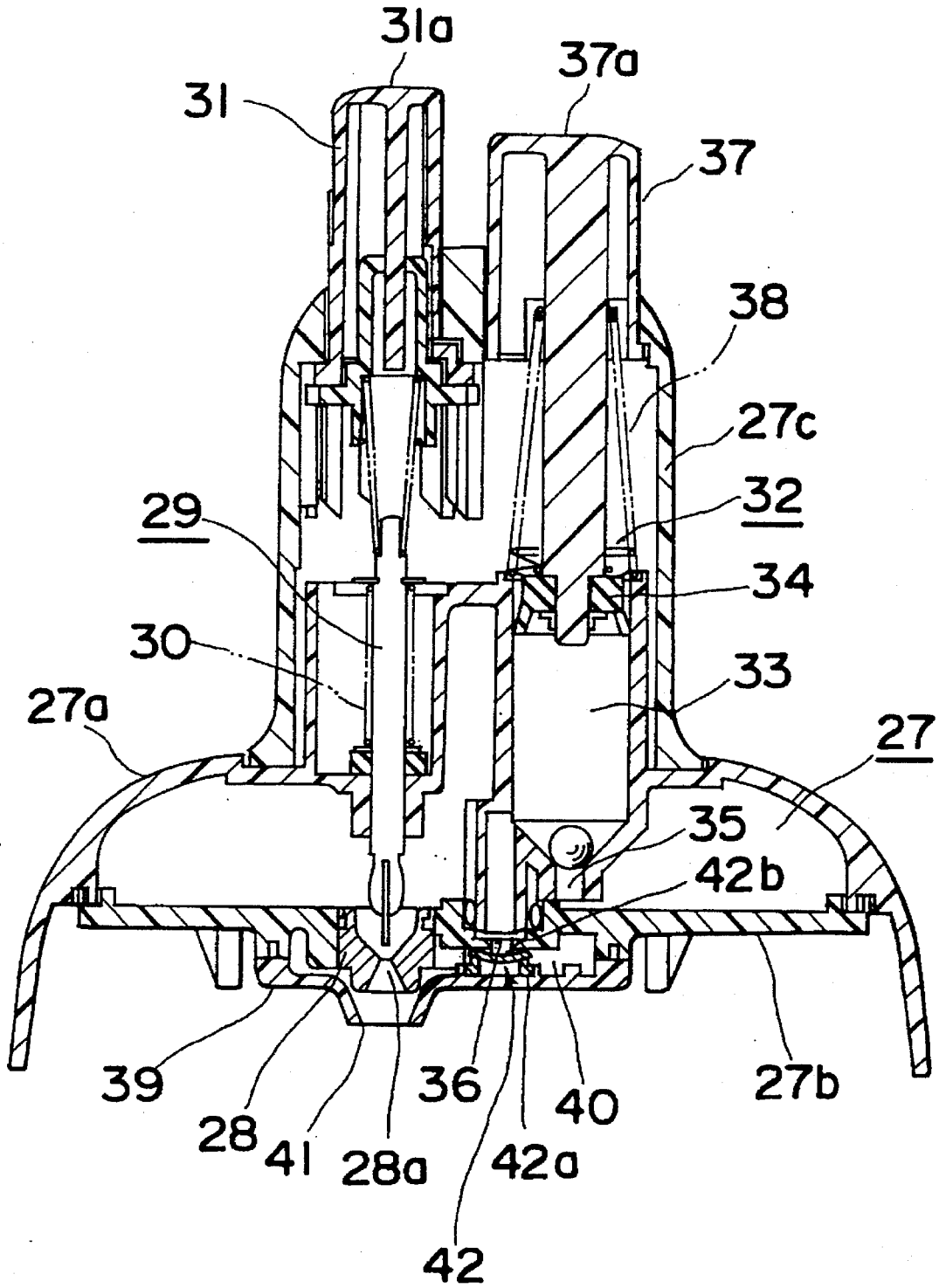
FIG. 2 is a fragmentary front sectional view, on an enlarged scale, of the steam iron of FIG. 1, showing internal mechanisms of a tank employed therein.
Figure 3:
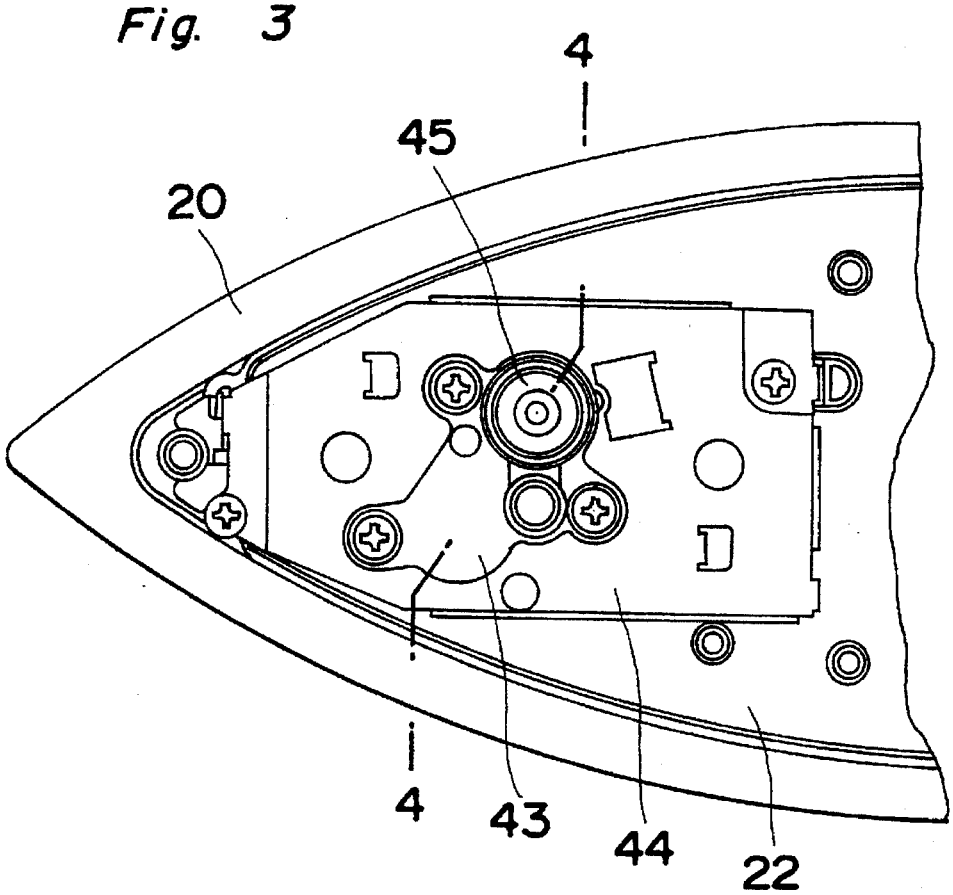
FIG. 3 is a fragmentary top plan view of a soleplate used in the steam iron of FIG. 1.

In practice, a ratchet spline mechanism of any known structure is interposed between the valving member 29 and the standard spray button 31 such that, while the standard spray button 31 is held in a depressed position so long as the steam is not called for during an ironing job with the minute nozzle perforation 28*a* consequently closed, a single push applied to the standard spray button 31 then held in the depressed position causes the latter to assume a full open position as shown in FIG. 2 to open the nozzle perforation 28*a* at a full opening, but a subsequent push applied to the standard spray button 31 then held at the full open position causes the latter to assume a position intermediate between the full open and depressed positions at which the nozzle perforation 28*a* is substantially half opened. In any event, this ratchet spline mechanism does not constitute subject matter of the present invention and, therefore, the details thereof are not reiterated herein for the sake of brevity.

Juxtaposed with the valving member 29 is a pumping mechanism 32 for supplying an increased quantity of water from the tank unit 27 into the vaporizing chamber 23 when the enhanced steam spraying mode is desired. This pumping mechanism 32 includes a plunger 34 movably accommodated within a cylinder 33, a reciprocating up and down movement of which results in a pumping of water from the water tank unit 27 into the cylinder 33 through an intake port 35 and then from the cylinder 33 into the vaporizing chamber 23 through a discharge port 36 open at the tank bottom wall 27*b*. This plunger 34, normally biased upwardly by a spring element 38, has an upper end portion protruding upwardly outwardly from the water tank unit 27 and formed integrally with, or otherwise capped with, an enhanced spray button 37 having an operating surface 37*a* defined atop the enhanced spray button 37 and accessible to a user's finger.

As best shown in FIGS. 1 and 2, a cover plate 39 is secured from below to the tank bottom wall 27*b* so as to cover the discharge port 36 of the pumping mechanism 32 and a discharge side of the nozzle member 28 and also to define a water passage 40 between it and the tank bottom wall 27*b*. This cover plate 39 is formed with an opening 41 of a diameter greater than the minute metering perforation 28*a* in the nozzle member 28 defined at a location immediately beneath the nozzle member 28. Through this opening 41 is the water passage 40 communicated with the vaporizing chamber 23.

A portion of the water passage 40 aligned with the discharge port 36 of the pumping mechanism 32 is provided with a check valve 42 supported in position in a fashion sandwiched between the tank bottom wall 27*b* and the cover plate 39. More specifically, as shown in FIG. 2, this check valve 42 is made of a flexible material such as natural or synthetic rubber or the like and is of a one-piece structure generally includes a cylindrical hollow body 42*a* and an end wall 42*b* closing one end of the cylindrical hollow body 42*a*. This check valve 42 is sandwiched between the tank bottom wall 27*b* and the cover plate 39 with the end wall 42*b* held in contact with a peripheral lip region of the discharge port 36 to close the discharge port 36. However, when the pumping mechanism 32 is operated to supply water under pressure through the discharge port 36, the check valve 42 itself opens, i.e., the end wall 36*b* is downwardly urged against its own resiliency by the pressure of the pumped water pumped by the pumping mechanism 32 to allow the pumped water to flow towards the vaporizing chamber 23 through the discharge port 36.

The standard spray button 31 of the valving member 29 and the enhanced spray button 37 of the pumping mechanism 32 are disposed in side-by-side fashion in a direction perpendicular to the lengthwise direction of the grip 25, and the operating surface 37*a* of the enhanced spray button 37 is chosen to have a larger surface area than that of the operating surface 31*a* of the standard spray button 31.

A water guide conduit 43 for guiding water from the water tank unit 27 to the vaporizing chamber 23 through the opening 41 in the cover plate 39 is formed above a support plate 44 mounted on the soleplate 20 and in a space between the covering 24 and the soleplate 20. As best shown in FIG. 4, this water guide conduit 43 is, when the tank unit 27 is mounted in position above a front portion of the soleplate 20, fluid-coupled with the opening 41 in the cover plate 24 in a water-tight fashion by means of a packing 45 mounted on the water guide conduit 43 so as to confront the covering 24. A portion of this water guide conduit 43 immediately beneath the opening 41 in the cover plate 39 is provided with a thermo-responsive valve assembly 46 including a valve rod 46*a* and a bimetal element 47 operatively associated with the valve rod 46*a*.

This thermo-responsive valve assembly 46 may be of any known construction such as disclosed in, for example, the previously discussed Japanese Laid-open Pat. Publication No. 61-263498 and is so designed that when the bimetal element 47 is concaved (occurring when the vaporizing chamber 23 is of a temperature lower than the vaporizing temperature) or convexed (occurring when the vaporizing chamber 23 is heated to the vaporizing temperature), the valve rod 46 can be displaced downwardly or upwardly to open or close the guide conduit 43, respectively. However, in the illustrated embodiment, the valve rod 46*a* and the bimetal element 47 are positioned offset relative to each other and, therefore, a transmission lever 46*d* is employed for transmitting a displacement of the bimetal element 47 to the valve rod 46*a*.

This transmission lever 46*d* has one end pivotally connected to a bracket 46*c* depending from the support plate 44 and the opposite end positioned immediately below the valve rod 46*a* and is formed integrally with a finger 46*b* extending downwardly from a generally intermediate portion of the transmission lever 46*d* at a location immediately above the bimetal element 47 as shown in FIG. 1. A spring element (not shown) is also employed to bias the transmission lever 46*d* to keep a free end of the downwardly extending finger 46*b* in contact with the bimetal element 47. Thus, it will readily be seen that an even slight temperature-responsive displacement in shape of the bimetal element 47 can result in a considerable shift of the valve rod 46*a*.

The steam iron of the above described construction according to the present invention operates in the following manner. Assuming that the heater 21 is electrically energized accompanied by heating of the vaporizing chamber 23 to the vaporizing temperature, the bimetal element 47 then assuming a downwardly curved shape is reversed to assume an upwardly curved shape, causing the valve rod 46*a* of the thermo-responsive valve assembly 46 to be displaced upwardly to open the water guide conduit 43 to thereby communicate the tank unit 27 with the vaporizing chamber 23. When during this condition the standard spray button 31 in the depressed position is moved to the full open position to open the nozzle member 28, water within the tank unit 27 flows dropwise into the water guide conduit 43 through the nozzle aperture 28*a* and then through the opening 41 and then into the vaporizing chamber 23. As the water flows into the vaporizing chamber 23 then heated to the vaporizing temperature, the water is vaporized to provide steam which is subsequently sprayed outwardly from spray perforations 48 in the soleplate 20. The intermediate position of the standard spray button 31 may be used where the amount of steam to be sprayed is desired to be small.

Where spraying of the steam is desired to be interrupted, the standard spray button 31 has to be pushed to the depressed position to close the nozzle 28 to thereby interrupt supply of water into the vaporizing chamber 23 by way of the water guide conduit 43. Thus, the switching can be accomplished quickly in response to manipulation of the standard spray button 31.

Where the enhanced steam spraying mode, i.e., the mode in which the quantity of steam being sprayed is temporarily increased as compared with that during the standard steam spraying mode, is desired, it can readily be accomplished by manipulating the enhanced spray button 37 up and down in a desired number of cycles to operate the pumping mechanism 32. As a result of reciprocating motion of the plunger 34, water within the water tank unit 27 is sucked into the cylinder 33 and is then gushed into the water passage 40 through the discharge port 36. As the water so pumped gushes into the water passage 40 through the discharge port 36, the pumped water urges the end wall **42*b* of the check valve 42 to displace downwardly against the resiliency of the material of the check valve 42, thereby opening the discharge port 36. The water then flowing into the water passage 40 flows into the water guide conduit 43 through the opening 41 in the cover plate 39 and subsequently into the vaporizing chamber 23 to provide an increased quantity of steam. In this way, an increased quantity of steam as compared with that afforded during the standard steam spraying mode can be sprayed outwardly from the soleplate 20 through the spray perforations 48. This enhanced steam spraying mode can be continued for a predetermined length of time by the manipulation of the enhanced spray button 37 in association with reduction in temperature inside the vaporizing chamber 23**.

When during the enhanced steam spraying mode the temperature inside the vaporizing chamber 23 decreases down to a value lower than the vaporizing temperature, the bimetal element 47 then assuming the upwardly curved shape reverses to assume the downwardly curved shape in response to reduction in temperature inside the vaporizing chamber 23, thereby causing the valve rod **46*a* of the thermo-responsive valve assembly 46 to displace downwardly to close the water guide conduit 43. With the water guide conduit 43 so closed by the thermo-responsive valve assembly 46, water is no longer supplied to the vaporizing chamber 23 even though the pumping mechanism 32 is operated, and water discharged into the water passage 40 is returned to the water tank unit 27, having flown backwardly through the nozzle perforation 28*a* in the nozzle member 28**.

At this time, foreign matter deposited on an upper surface of the nozzle member 28, which is otherwise difficult to remove with a normally gentle flow of water passing through the nozzle perforation **28*a* from a side of the water tank unit 27, can be effectively removed by causing the pumping mechanism 32 to create a forced backward flow of water through the nozzle aperture 28*a*, wherefore regardless of whether the standard steam spraying mode is in operation or whether the enhanced steam spraying mode is in operation, a stabilized dropwise supply of water into the vaporizing chamber 23** is advantageously ensured.

As hereinabove discussed, water within the water tank unit 27 can be supplied through the two different fluid circuits to the vaporizing chamber 23 by way of the single opening 41 in the cover plate 39 rigid or integral with the bottom wall **27*b* of the tank unit 27 and, therefore, a reliably fluid-tight connection with the vaporizing chamber 23 can be accomplished in a simplified fashion. Also, since the thermo-responsive valve assembly 46 is disposed immediately beneath the opening 41 in the cover plate 39, water having flown past the thermo-responsive valve assembly 46 can be immediately supplied to the vaporizing chamber 23, making it possible to shorten the length of the water guide conduit 43 that extends along an upper surface of the soleplate 20**.

Also, since the check valve 42 disposed in face-to-face relation with the discharge port 36 of the pumping mechanism 32 is so designed that its own resiliency can be utilized to close the discharge port 36, there is no possibility that the check valve 42 may open the discharge port 36 under the influence of vibrations or impacts imposed on the steam iron and, also, any possible leakage of water within the cylinder 33 into the water passage 40 to thereby ensure an assured interruption of steam spraying.

Figure 7:
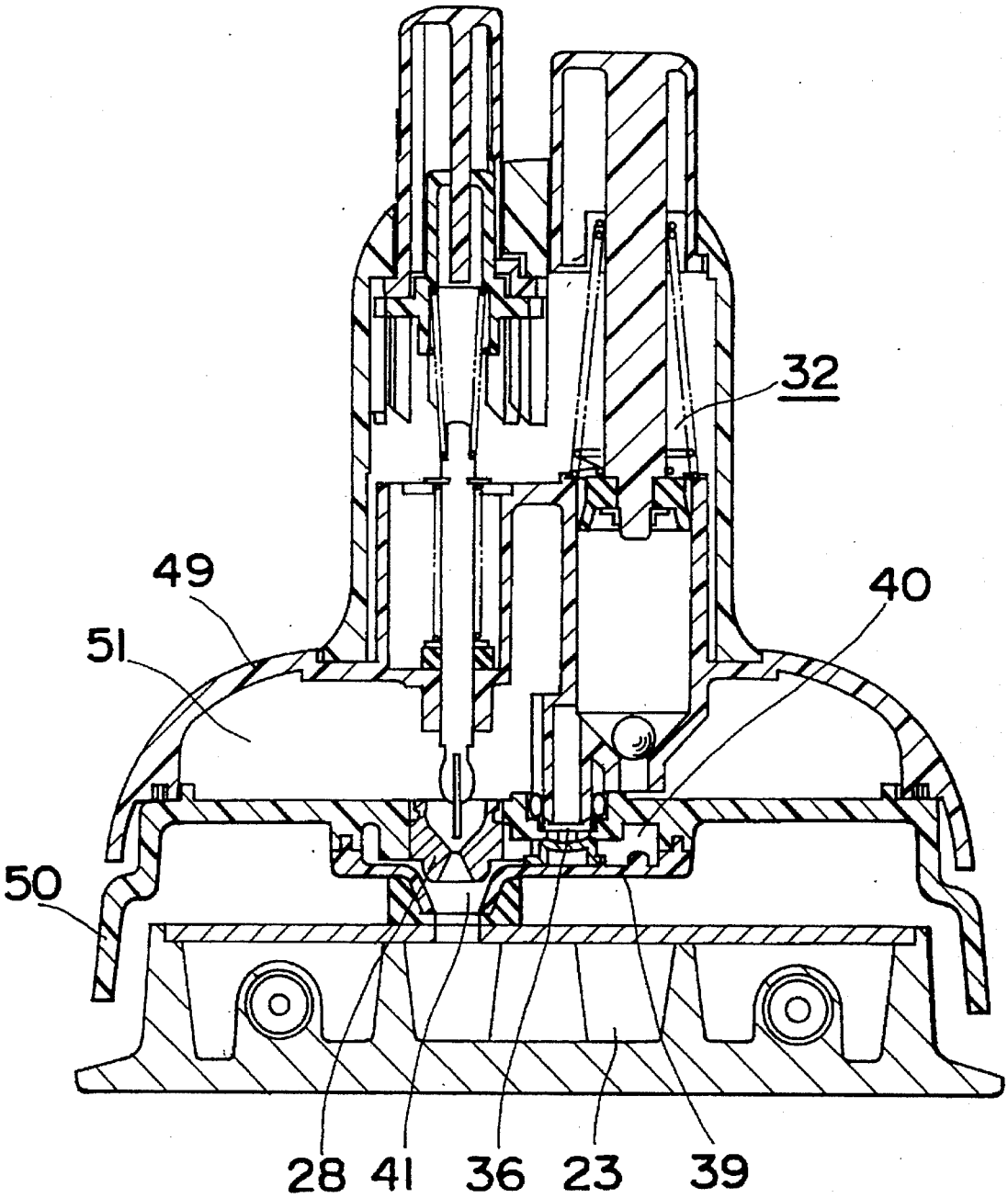
FIG. 7 is a view similar to FIG. 2, showing another preferred embodiment of the present invention.
Figure 8:
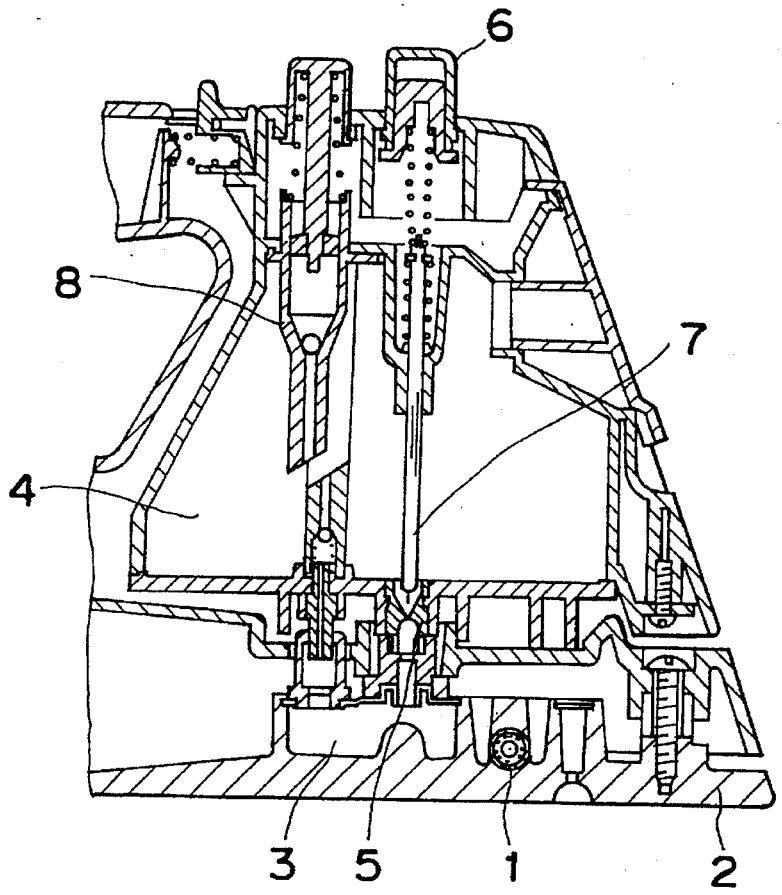
Fig. 8 Prior Art
FIG. 8 is a fragmentary side sectional view of a front portion of the first-discussed prior art steam iron.
Figure 10:
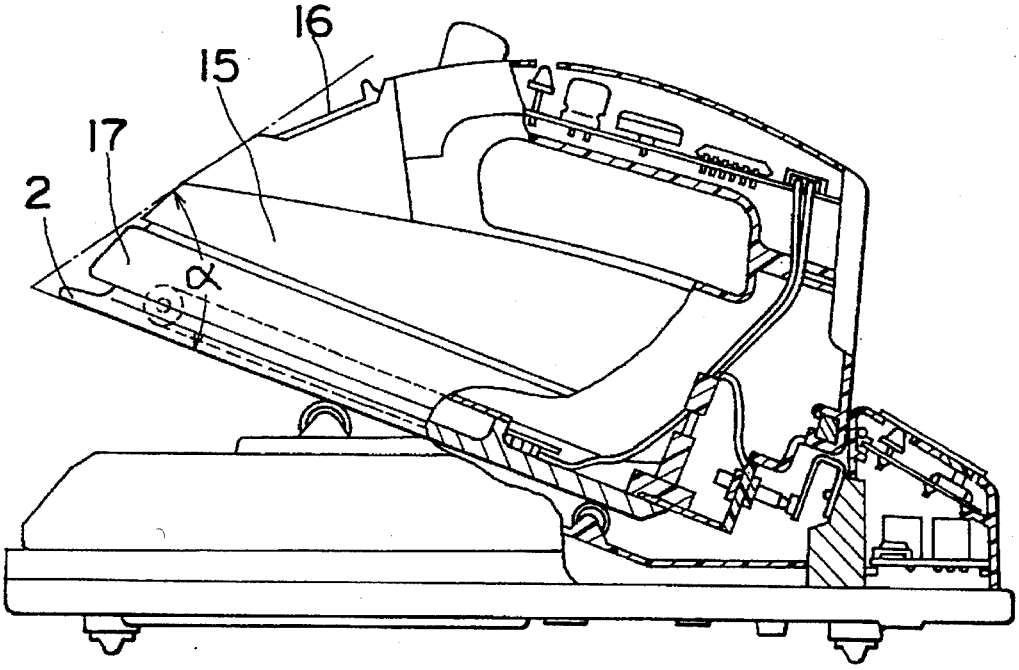
Fig. 10 Prior Art
FIG. 10 is a side view, with a portion cut away, of the third-discussed prior art steam iron.
Figure 9:
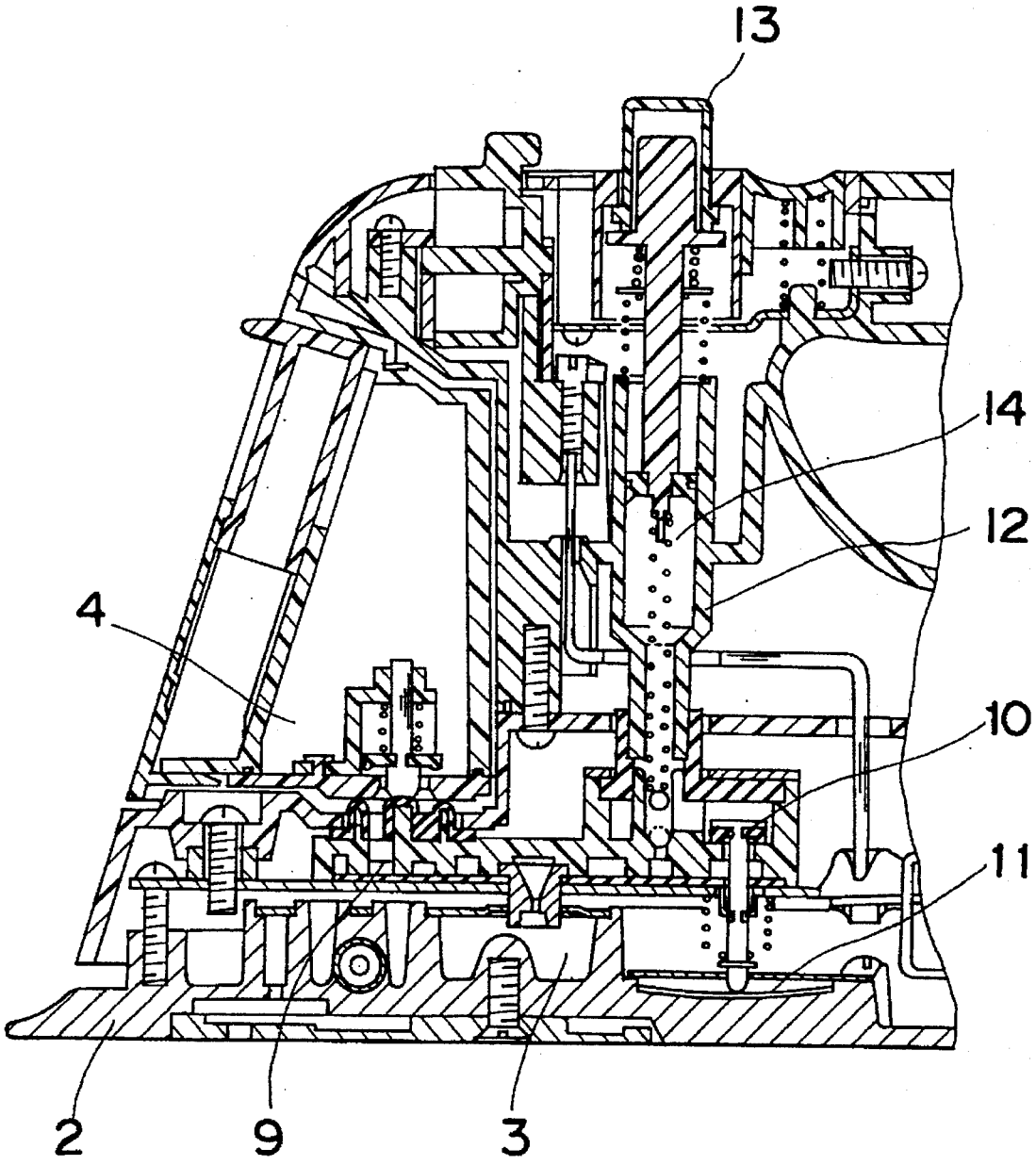
Fig. 9 Prior Art
FIG. 9 is a view similar to FIG. 8, showing a front portion of the second-discussed prior art steam iron.

FIG. 7 illustrates a different, but preferred embodiment of the present invention. While in the foregoing embodiment of the present invention the water tank unit 27 has been described as removable from the body of the steam iron, a water tank unit 51 which is used in the embodiment of FIG. 7 and which is functionally similar to the water tank unit 27 in the foregoing embodiment is constituted by a handle 49 and a covering 50. In other word, the cover plate 39 is secured to an undersurface of the covering 50 so as to cover the discharge port 36 of the pumping mechanism 32 and an exit side of the nozzle member 28, with the water passage 40 defined between this cover plate 39 and the covering 50 while the opening 41 in the cover plate 39 and leading to the vaporizing chamber 23 is disposed immediately beneath the nozzle member 28.

Even in the embodiment shown in FIG. 7, water within the water tank unit 51 can be supplied through the two different fluid circuits to the vaporizing chamber 23 by way of the opening 41 in the cover plate 39 and, therefore, a reliably fluid-tight connection with the vaporizing chamber 23 can be accomplished in a simplified fashion as is the case with the previously discussed embodiment. Also, it is needless to say that the opening 41 in the cover plate 39 is communicated with the vaporizing chamber 23 through the water guide conduit 43 which is selectively closed and opened by the thermo-responsive valve assembly 46.

Although the present invention has been described in connection with the preferred embodiments thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. An electric steam iron having a standard steam spray mode, in which a quantity of steam is sprayed, and an enhanced steam spray mode in which an increased quantity of steam is sprayed as compared with that afforded during the standard steam spray mode, said electric steam iron comprising:

a soleplate having a heater mounted thereon for heating the soleplate, said soleplate having a vaporizing chamber defined therein;

a handle disposed above the soleplate;

a water tank unit for supplying water to the vaporizing chamber;

a nozzle disposed at a bottom of the water tank unit;

a valving mechanism for selectively opening and closing the nozzle for controlling supply of water to the vaporizing chamber;

a pumping mechanism for supplying an increased quantity of water within the water tank unit towards the vaporizing chamber to accomplish the enhanced steam spray mode; and a cover plate defining a water passage beneath the water tank unit and covering the pumping mechanism and an exit side of the nozzle, said cover plate having an opening defined therein in communication with the vaporizing chamber.

2. The electric steam iron as claimed in claim 1, wherein said opening in the cover plate has a diameter greater than that of a nozzle aperture in the nozzle and is positioned immediately beneath the nozzle.

3. The electric steam iron as claimed in claim 2, wherein said valving mechanism and said cover plate is provided in the water tank unit, and said water tank unit is removable relative to a body of the steam iron.

4. The electric steam iron as claimed in claim 1, further comprising a water guide conduit defined at a downstream side of the opening in the cover plate with respect to a direction of flow of water towards the vaporizing chamber, and a thermo-responsive valve assembly disposed beneath the opening in the cover plate, said thermo-responsive valve assembly being operable to open said water guide conduit to establish a fluid circuit when the vaporizing chamber is heated to a vaporizing temperature at which water is vaporized to provide steam.

5. The electric steam iron as claimed in claim 4, wherein said valving mechanism and said cover plate is provided in the water tank unit, and said water tank unit is removable relative to a body of the steam iron.

6. The electric steam iron as claimed in claim 1, wherein said pumping mechanism has a discharge port communicated with the water passage, and further comprising a check valve normally closing the discharge port of the pumping mechanism, said check valve being in the form of a flexible tubular member made of a flexible material.

7. The electric steam iron as claimed in claim 6, wherein said valving mechanism and said cover plate is provided in the water tank unit, and said water tank unit is removable relative to a body of the steam iron.

8. The electric steam iron as claimed in claim 6, wherein said check valve is supported sandwiched between a bottom wall member of the water tank unit and the cover plate.

9. The electric steam iron as claimed in claim 8, wherein said valving mechanism and said cover plate is provided in the water tank unit, and said water tank unit is removable relative to a body of the steam iron.

10. The electric steam iron as claimed in claim 1, wherein said valving mechanism and said cover plate is provided in the water tank unit, and said water tank unit is removable relative to a body of the steam iron.

11. An electric steam iron having a standard steam spray mode, in which a quantity of steam is sprayed, and an enhanced steam spray mode in which an increased quantity of steam is sprayed as compared with that afforded during the standard steam spray mode, said electric steam iron comprising:

a soleplate having a heater mounted thereon for heating the soleplate, said soleplate having a vaporizing chamber defined therein;

a handle disposed above the soleplate;

a water tank unit for supplying water to the vaporizing chamber;

a nozzle disposed at a bottom of the water tank unit;

a valving mechanism for selectively opening and closing the nozzle for controlling supply of water to the vaporizing chamber;

a pumping mechanism for supplying an increased quantity of water within the water tank unit towards the vaporizing chamber to accomplish the enhanced steam spray mode;

a water guide conduit having an outflow port and operable to guide water within the water tank unit to flow into the vaporizing chamber; and a thermo-responsive valve assembly operable to open said water guide conduit to establish a fluid circuit when the vaporizing chamber is heated to a vaporizing temperature at which water is vaporized to provide steam, said thermo-responsive valve assembly being disposed at a location between the outflow port of the water guide conduit and a portion of the water guide conduit where water from the pumping mechanism and the nozzle joins the water guide conduit.

12. An electric steam iron having a standard steam spray mode, in which a quantity of steam is sprayed, and an enhanced steam spray mode in which an increased quantity of steam is sprayed as compared with that afforded during the standard steam spray mode, said electric steam iron comprising:

a soleplate having a heater mounted thereon for heating the soleplate, said soleplate having a vaporizing chamber defined therein;

a handle disposed above the soleplate;

a water tank unit for supplying water to the vaporizing chamber;

a nozzle disposed at a bottom of the water tank unit;

a valving mechanism for selectively opening and closing the nozzle for controlling supply of water to the vaporizing chamber;

a pumping mechanism for supplying an increased quantity of water within the water tank unit towards the vaporizing chamber to accomplish the enhanced steam spray mode;

a first operating member having a first operating surface accessible to a user's finger for operating the valving mechanism; and a second operating member having a second operating surface accessible to a user's finger for operating the pumping mechanism, said first and second operating members being juxtaposed with each other in a direction substantially perpendicular to a direction in which the handle extends, said first operating member, said first operating surface having a larger surface area than the second operating surface.

13. An electric steam iron comprising:

a soleplate having a heater mounted thereon for heating the soleplate, said soleplate having a vaporizing chamber defined therein;

a covering mounted on the soleplate so as to cover an upper region of the soleplate;

a handle disposed mounted on an upper portion of the covering;

a removable water tank unit for supplying water to the vaporizing chamber;

a water fill unit fitted to a front upper portion of the water tank unit and having a water fill port defined in a front surface of the water fill unit;

said water tank unit having a upper wall member defining an upper surface of the water tank unit, said upper wall member having a tip formed with a bulged portion protruding forwardly from a lower end of the water fill unit while leaving a setback region at a location between the bulged portion and the water fill unit.

14. The electric steam iron as claimed in claim 13, wherein said bulged portion covers upper and side surfaces of a front portion of the covering and is positioned at a level lower than a bottom wall member of the water tank unit, said bottom wall member defining a bottom of the water tank unit.

* * * * *

UNITED STATES PATENT AND TRADE MARK OFFICE

CERTIFICATE OF CORRECTION

PATENT NO. : 5,630,287
DATED : May 20, 1997
INVENTOR(S) : Shimosaka et al.

It is certified that error appears in the above-identified patent and that said Letters Patent is hereby corrected as shown below:

On the cover page, item [73] Assignee, delete "Matsushita Electric Co., Ltd." and insert --Matsushita Electric Industrial Co., Ltd.--.

Signed and Sealed this

Twenty-fourth Day of February, 1998

*Attest:*

Bruce Lehman

BRUCE LEHMAN

*Attesting Officer*

*Commissioner of Patents and Trademarks*